US011738935B1

(12) United States Patent
Koenig et al.

(10) Patent No.: US 11,738,935 B1
(45) Date of Patent: Aug. 29, 2023

(54) EXPANDABLE PIZZA CONTAINER

(71) Applicants: Tate Koenig, Aurora, OR (US); Matt Poeschi, Aurora, OR (US)

(72) Inventors: Tate Koenig, Aurora, OR (US); Matt Poeschi, Aurora, OR (US)

( * ) Notice: Subject to any disclaimer, the term of this patent is extended or adjusted under 35 U.S.C. 154(b) by 0 days.

(21) Appl. No.: 17/727,683

(22) Filed: Apr. 22, 2022

(51) Int. Cl.
*B65D 85/36* (2006.01)

(52) U.S. Cl.
CPC ..... *B65D 85/36* (2013.01); *B65D 2585/366* (2013.01)

(58) Field of Classification Search
CPC . B65D 6/00; B65D 6/18; B65D 43/02; B65D 43/0204; B65D 43/0222; B65D 81/26; B65D 81/261; B65D 85/36; B65D 85/54; B65D 2585/366; B65D 21/08
USPC ..... 206/551; 220/666, 667
See application file for complete search history.

(56) References Cited

U.S. PATENT DOCUMENTS 5,269,430 A * 12/1993 Schlaupitz ..... B65D 43/162 206/551
D393,883 S * 4/1998 Haygood ..... D21/372
5,862,932 A * 1/1999 Walsh ..... B65D 21/086 220/666
6,315,151 B1 * 11/2001 Hupp ..... B65D 21/086 220/666
8,317,047 B2 * 11/2012 Vanderberg ..... F25D 3/06 220/666
9,260,221 B1 * 2/2016 Hertz ..... B65D 21/0222
9,486,096 B1 * 11/2016 Hertz ..... B65D 85/72
9,718,573 B1 * 8/2017 Hertz ..... B65D 85/72
11,325,753 B2 * 5/2022 Johnson ..... B65D 43/0204
2003/0015534 A1 * 1/2003 Lown ..... B65D 43/0218 220/324
2014/0262920 A1 * 9/2014 Andrews ..... B65D 81/261 206/551
2021/0237933 A1 * 8/2021 Swarts ..... B65D 21/08

* cited by examiner

*Primary Examiner* — Bryon P Gehman
(74) *Attorney, Agent, or Firm* — Mark S Hubert

(57) ABSTRACT

An expandable triangular pizza storage container with a set of triangular trays for the separation, microwaving and serving of individual slices of pizza. The storage container has a series of concentric triangular compartments that are expanded from a flexible polymer, accordion-style container body. The lid also has a triangular configuration with a replaceable compressible gasket, a set of four locking wings extending from each side that frictionally engage a rigid triangular top ring of the container body, and a central vent.

6 Claims, 6 Drawing Sheets

EXPANDABLE PIZZA CONTAINER

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to food storage technology, and more particularly to an expandable, multi-slice pizza storage container.

BACKGROUND

Pizza is one of the staples of the American diet. The drawback is that pizza from restaurants and to-go pizza parlors, generally don't come in single serving portions. Rather, they come sliced in whole pies, enough to feed four or more people. This causes a dilemma when a pizza pie is ordered for less than four people. This causes the leftovers to be individually wrapped or put into multiple storage containers. This takes unnecessary space in the refrigerator since pizza slices are generally triangular and conventional refrigerator storage containers are square or round. Regardless, they must be microwaved individually on another plate, and both the plate and container must be washed.

Henceforth, a dedicated pizza storage container that was adapted for the storage and reheating of multiple slices of pizza pie would fulfill a long felt need in food storage industry. This new invention utilizes and combines known and new technologies in a unique and novel configuration to overcome the aforementioned problems and accomplish this.

BRIEF SUMMARY

In accordance with various embodiments, an expandable, triangular, multi-slice pizza storage container is provided.

In one aspect, a pizza container with triangular trays for use in the separation of pizza slices to be stored, as well as for use as an individual pizza slice microwaveable and serving tray is provided.

In another aspect, a triangular expandable, multi-level pizza storage container with a vented, lockable lid is provided.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION OF CERTAIN EMBODIMENTS

Figure 1:
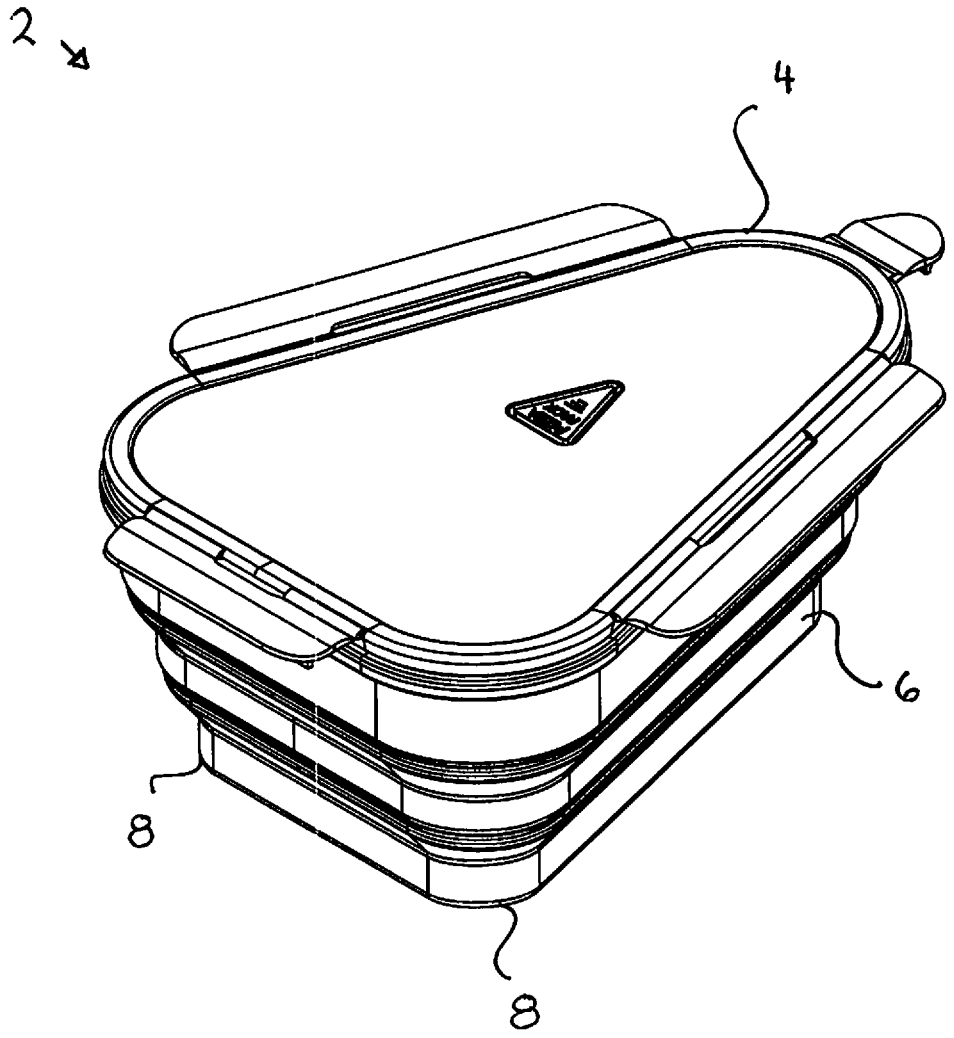
FIG. 1 is a perspective top view of the expanded pizza storage container with the lid in an unlocked configuration.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As used herein, the term "bulbous" refers to s shape that resembles a light bulb with a generally spherical end top end that is necked down in diameter at its other end.

As used herein the term "generally triangular shape" refers to a geometric configuration of a triangle with rounded corners.

The present invention relates to a novel design for a vertically expandable triangular, pizza storage container with a vented lockable lid and separation/serving trays that are microwaveable.

Figure 2:
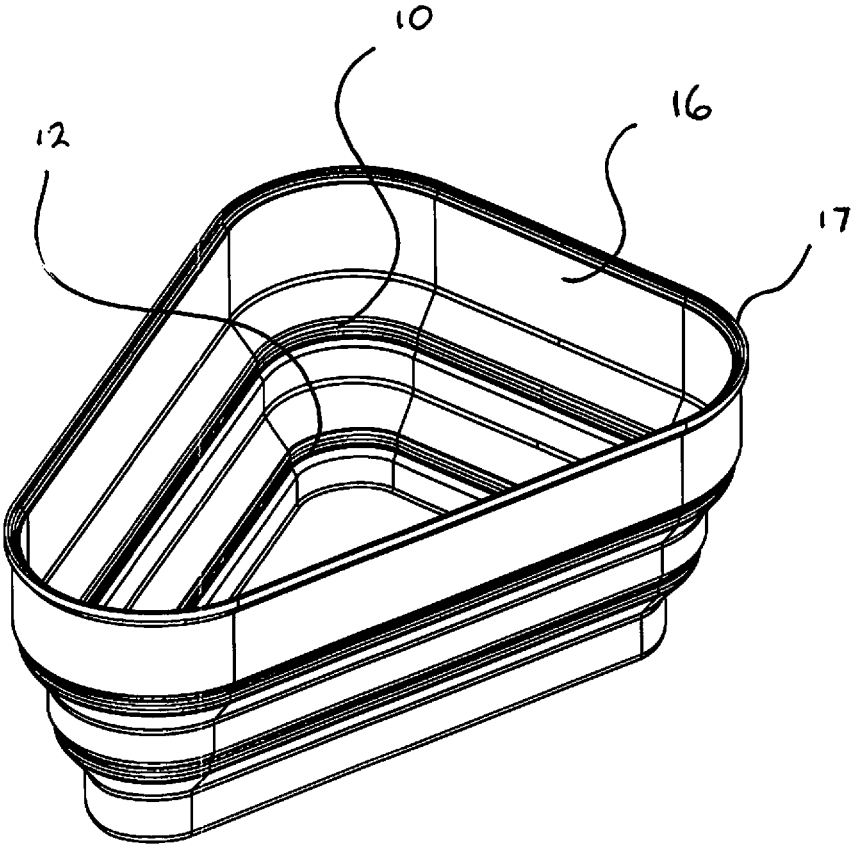
FIG. 2 is a perspective top view of the expanded pizza storage container with the lid removed.
Figure 9:
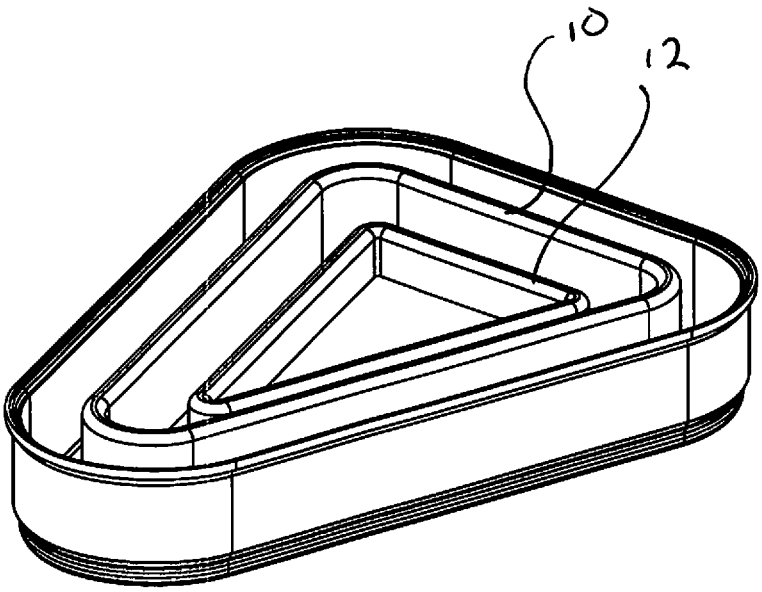
FIG. 9 is a perspective top view of the collapsed pizza storage container.
Figure 10:
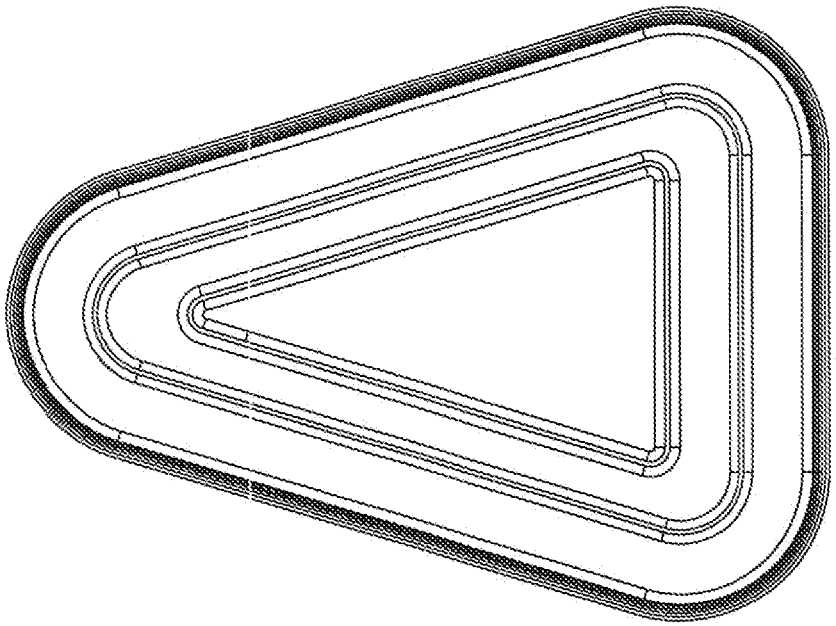
FIG. 10 is a top view of a collapsed pizza storage container.

Looking at FIGS. 1 and 2 the expandable pizza container 2 ("container") can be seen in its expanded configuration with and without the lid 4 on the container body 6. The body 6 has a generally triangular shape with rounded corners 8. It is made of a flexible polymer and its three sides 16 are pleat folded in the style of an accordion so as to form an upper pleat 10 and a lower pleat 12. Although in alternate embodiments, there may be more or less pleats. When the container body 6 is collapsed (FIGS. 9 and 10) these two pleats are concentrically nested in the same plane. These two pleats allow the container body 6 to have five concentric vertical levels of pizza storage when the container body 6 is expanded. The container body 6 has a planar, unadorned bottom face.

Figures 6, 7, 8:
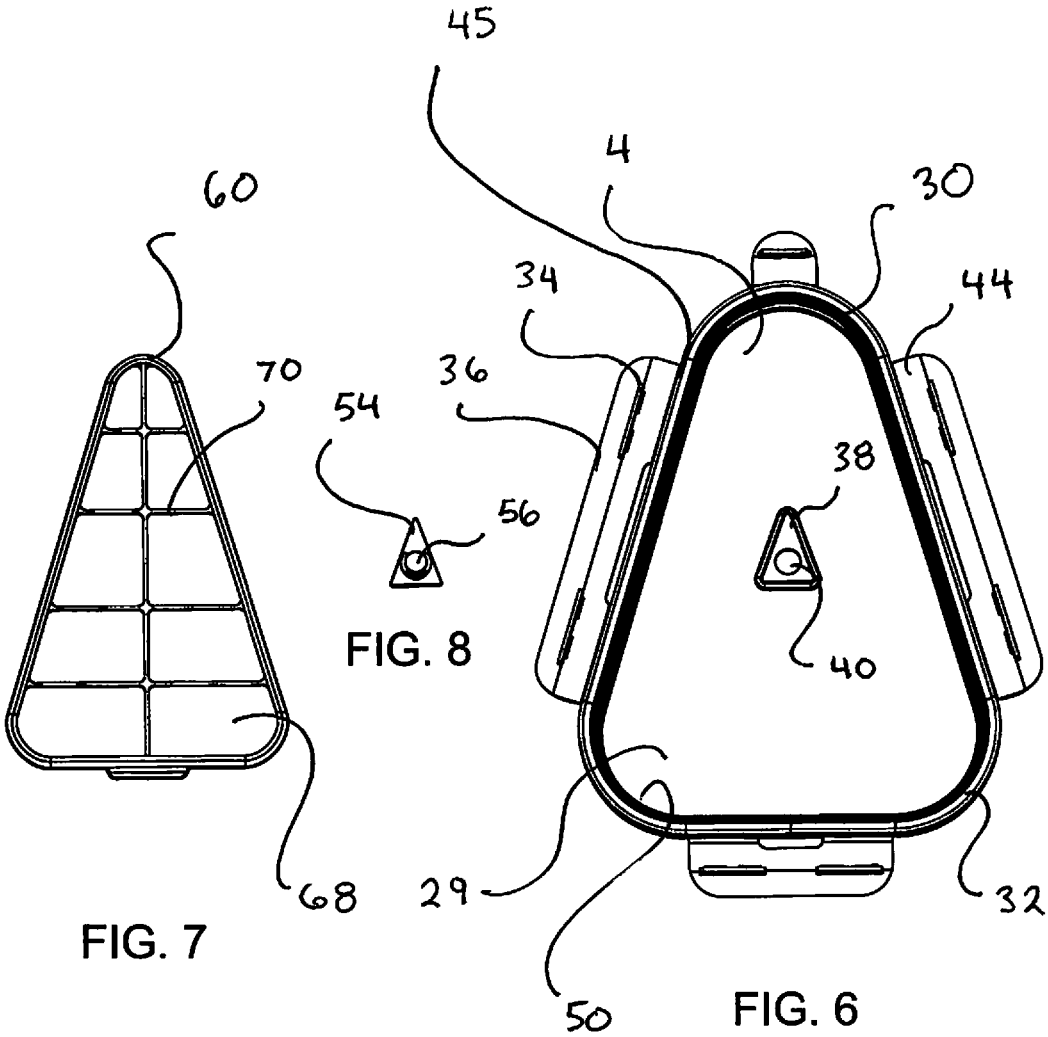
FIG. 6 is a bottom view of the lid.
FIG. 7 is a bottom view of the tray.
FIG. 8 is a bottom view of the vent cap.
Figure 11:
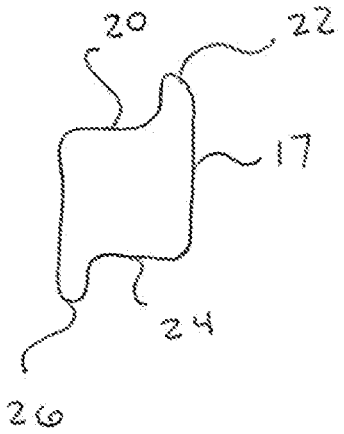
FIG. 11 is a cross sectional view of the container body's seal ring.

The top peripheral edge of the container body 6 has a rigid polymer seal ring 17 bonded to the top of the flexible sides 16. In the seal ring's cross section view (FIG. 11) it can be seen that it is a solid generally triangular ring, with a planar top face 20 having an inner raised lip 22, and planar bottom face 24 having an outer raised lip 26. The top face 20 serves as a surface for the compression of the removeable, compressible gasket 30 housed in the gasket groove 32 of the lid 4. (FIG. 6). The outer raised lip 26 acts to frictionally secure the lock tabs 34 of the locking wings 36 extending from the lid 4 and ensures the lid 4 stays on and the gasket 30 stays compressed guaranteeing freshness of the container's contents.

Figure 3:
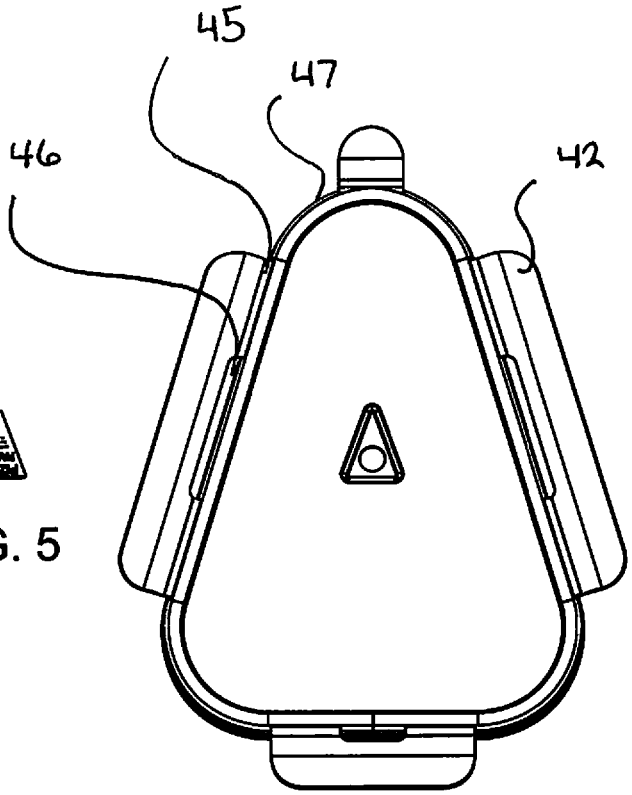
FIG. 3 is a top view of the lid with the vent cap removed.

Looking at FIGS. 3 and 6, the lid 4 can best be described. The lid 4 also has a generally triangular shape and a planar top face 29 with an orifice 40 formed in a triangular depression 38 thereon. The lid 4 is made of a rigid, transparent polymer and has a series of four hinged locking wings 36 extending from the sides of the lid 4. Each locking wing 36 has a top face 42 and a bottom face 44 with at least one T shaped lock tab 34 projecting perpendicularly from its bottom face 44. The hinges 45 are merely extensions of the locking wings 36 onto the lid's outer periphery 47. These hinges 45 do not extend the full length of the locking wings 36 as there are through slots 46 used to minimize the amount of material in the hinge 45 for flexibility purposes.

The lid 4 has a compressible polymer gasket 30 that is frictionally housed in the generally triangular gasket groove 32 that runs around the outer edge of the lid 4. The gasket groove 32 is formed adjacent an inner lid flange 50 that extends perpendicularly downward from the bottom face of the lid 4, tracing the same generally triangular configuration as the lid 4 and the container body 6. When the lid 4 is fitted onto the container body 6, the inner lid flange 50 abuts the seal ring 17 and aligns the lid 4 and the container body 6 so that the compressible gasket 30 is properly seated onto the planar top face of the seal ring 17 prior to compression.

Figure 12:
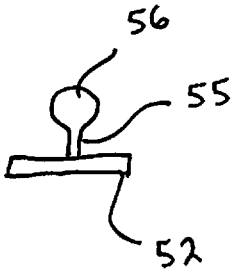
FIG. 12 is a cross sectional view of the bulbous extension.
Figure 5:
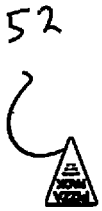
FIG. 5 is a top view of the vent cap.

The vent cap 52 (FIG. 5) is a flexible triangular flap sized to fit within the triangular depression 38 on the lid 4. Its bottom face 54 has a bulbous extension 56 extending therefrom that is compressible and pliable, and sized slightly larger than the orifice 40. (FIG. 8) With the application of side to side and downward pressure on the top face of the vent cap 52 the bulbous extension 56 will pass through the orifice 40 and retain the triangular vent cap 52 in the triangular depression 38. Since the extension 56 has a bulbous configuration, the neck 55 has a diameter less than the diameter of the orifice 40. (See FIG. 12) This narrower neck of the extension, being smaller than the orifice 40, allows the vent cap to rise in the depression 38 as needed to allow pressurized air from the sealed container to escape. Gravity and the frictional forces of the taper of the neck 55 the extension 56 causes the vent cap 52 to close when the pressurized air has been vented.

Figure 4:
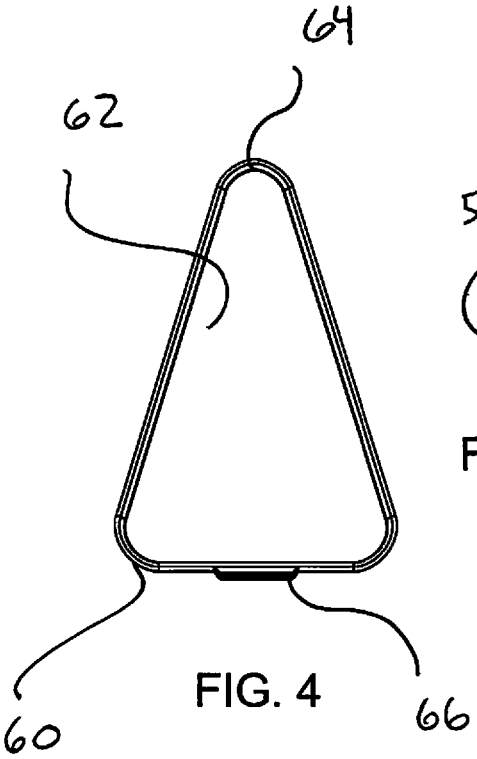
FIG. 4 is a top view of the tray.

Looking at FIGS. 4 and 7 the microwave safe trays 60 can best be seen. These trays 60 also share the same generally triangular configuration as the container body 6 and lid 4, although dimensionally it is slightly smaller than the container body's bottom face 14 so a tray 60 may be used on even the lowest of pizza slices in the container 6. The trays 60 have a planar top face 62 and a peripheral lip 64 extending around the tray 60. This holds the slice of pizza on the tray 60 as well as any oils that drip from the pizza during the microwave process. On one side of the tray 60, there is a raised finger tab 66 for lifting the tray 60 and its slice of pizza. The bottom face 68 of the tray 60 has a grid of raised bars 70 extending perpendicularly therefrom. This minimizes the contact that the bottom of each tray 60 will have with the top of the slice of pizza that the tray is put on. This minimizes the transfer of oils and greases from the slice of pizza to the bottom face 68 of the tray 60 and also prevents the stacked pizza slices from sticking together.

The expandable pizza container is used to store (refrigerate) multiple slices of pizza stacked atop each other and separated by triangular trays that serve to prevent the pizza slices from sticking together, to provide a drip tray to collect oils and greases when microwaved, and to act as a serving tray for single slices. The container has a vented lid with a series of locking tabs—one per container side.

In use, the lid is removed, and the bottom of the container pressed downward to expand the accordion nestled concentric triangular compartments. Slices of pizza are layered into the container from the bottom up, separated by the insertion of triangular, microwaveable trays (planar side up) between the pizza slices. When all slices are inside, the container lid is pressed into place ensuring that the lid's flexible gasket is compressed on the container's rigid top seal ring and the vent cap is free. The four side locking wings are rotated from a horizontal to a vertical position until the gasket is compressed and the lock tabs on the locking wings are frictionally captured beneath the lock tabs on the sides of the container. The bottom of the container is gently pressed upward and the nestled concentric triangular compartments are collapsed until the top slice of pizza is in close proximity to the lid. When this compartment collapse is undertaken, the vent cap will lift up slightly to allow the compressed air to escape, helping ensure freshness.

When an individual slice of pizza is desired, the lid's locking wings are rotated to an upward, horizontal position to release the lid from its frictional engagement with the container's lock tabs, and decompress the compressible gasket. The lid is removed. The tray under the top slice of pizza with the slice of pizza thereon is removed and placed in the microwave. Once heated the tray and slice of pizza are removed from the microwave and served as a unit. The above procedure is repeated to further collapse, vent and seal the container, and the container is again ready for storage.

While certain features and aspects have been described with respect to exemplary embodiments, one skilled in the art will recognize that numerous modifications are possible. Consequently, this detailed description and accompanying material is intended to be illustrative only, and should not be taken as limiting the scope of the inventive concept. What is claimed as the invention, therefore, is all such modifications as may come within the scope and spirit of the following claims and equivalents thereto.

Having thus described the invention, what is claimed as new and desired to be secured by Letters Patent is as follows:

1. An expandable pizza storage container, comprising:

a flexible, generally triangular container body having three sides joined at rounded corners, and a planar bottom face extending perpendicularly from a bottom edge of said sides, wherein said sides are pleat folded so as to form an upper pleat and a lower pleat that are concentrically nested;

a rigid seal ring bonded to a top edge of said sides;

a rigid, generally triangular, planar lid with a gasket groove formed about a periphery edge of a bottom side of said lid;

a compressible, removeable gasket frictionally retained within said gasket groove;

a microwave safe triangular tray with a peripheral lip formed there about a tray top face and a finger tab extending from said triangular tray;

wherein said lid resides upon said container body with said gasket in contact with said seal ring, and said tray resides within said container body.

2. The expandable pizza storage container of claim 1, further comprising:

a vent cap operationally installed for upward and downward motion in an orifice formed in a depression formed on said lid;

a series of four hinged locking wings extending from said periphery edge of said lid, said locking wings having T-shaped lock tabs extending perpendicularly from a lower face of said locking wings;

wherein said seal ring is a solid generally triangular ring, with a planar top face having an inner raised lip, and a planar bottom face having an outer raised lip;

wherein said locking wings are pivotally engaged about said seal ring and said lock tabs engage around said outer raised lip so as to compress said gasket on said planar top face of said seal ring.

3. The expandable pizza storage container of claim 2, further comprising:

an inner lid flange adjacent to said gasket groove and extending perpendicularly downward from said bottom side of said lid ((4)), said inner lid flange having a slightly smaller generally triangular configuration as said inner raised lip of said seal ring, so as to enable proper orientation of said lid onto said seal ring.

4. The expandable pizza storage container of claim 3, further comprising:

a grid of raised bars extending perpendicularly from a bottom face of said tray.

5. The expandable pizza storage container of claim 4 wherein said vent cap has a triangular shape, a top vent face, a bottom vent face and a flexible, compressible bulbous extension sized for frictional engagement with said orifice.

6. The expandable pizza storage container of claim 5 wherein there are five concentric vertical levels of pizza storage formed therein when said container body is expanded.

* * * * *